United States Patent [19]

Barnard et al.

[11] 4,266,837

[45] May 12, 1981

[54] ICE MAKER MOUNTING

[75] Inventors: Walter C. Barnard, White Bear Lake; Kenneth J. Dahlstrom, St. Paul, both of Minn.

[73] Assignee: Whirlpool Corporation, Benton Harbor, Mich.

[21] Appl. No.: 67,537

[22] Filed: Aug. 17, 1979

[51] Int. Cl.[3] ..... A47B 81/00; F25D 11/00

[52] U.S. Cl. ..... 312/351; 312/214; 312/236

[58] Field of Search ..... 312/138 R, 214, 236, 312/311, 341 R, 350, 351; 62/81, 96 E, 278, 285, 49; 298/214, 235

[56] References Cited

U.S. PATENT DOCUMENTS

| | | | |
|---|---|---|---|
| 3,051,215 | 3/1970 | Gartner | 312/214 |
| 3,066,757 | 12/1962 | Robinson et al. | 298/235 |
| 3,294,461 | 12/1966 | Barnard et al. | 312/213 |
| 3,421,803 | 1/1969 | Lustig | 312/351 |
| 3,669,520 | 6/1972 | Jansen | 312/351 |
| 3,773,399 | 11/1973 | Sulcek | 312/214 |
| 3,858,409 | 1/1975 | Besing | 312/214 |
| 3,910,658 | 10/1975 | Lindenschmidt | 312/214 |
| 3,913,996 | 10/1975 | Benford | 312/214 |
| 3,933,398 | 1/1976 | Haag | 312/214 |
| 3,952,905 | 4/1976 | Rumrill | 312/351 |
| 3,989,329 | 11/1976 | Benford | 312/214 |
| 3,999,820 | 12/1976 | Haag | 312/214 |
| 4,006,947 | 2/1977 | Haag et al. | 312/214 |
| 4,087,143 | 5/1978 | Barnard et al. | 312/214 |
| 4,098,094 | 7/1978 | Limstromberg | 312/311 |

*Primary Examiner*—Casmir A. Nunberg

*Attorney, Agent, or Firm*—Wegner, Stellman, McCord, Wiles & Wood

[57] ABSTRACT

Structure for mounting an ice maker in an insulated cabinet having an outer rigid metal shell. The mounting structure includes a support fixedly secured to the shell and defining a mounting portion disposed within a refrigerated chamber of the cabinet. The ice making apparatus is mounted to the support to be disposed within the refrigerated chamber. The shell includes turned flange portions to which the support is removably secured in one embodiment of the invention. The support may be defined by a plurality of rails having securing portions secured to the shell. Connecting portions may be arranged to extend from the securing portions to dispose the mounting portion of the support within the refrigerated chamber. The ice making apparatus may include a plurality of components such as an ice slab forming component and an ice slab dividing component. The support is arranged to mount the components in opposite association within the refrigerated chamber.

17 Claims, 6 Drawing Figures

ICE MAKER MOUNTING

BACKGROUND OF THE INVENTION

1. Technical Field

This invention relates to ice makers and in particular to means for mounting an ice making apparatus within a refrigerated chamber defined by a cabinet.

2. Background Art

In one form of refrigeration apparatus, means are provided for forming a plurality of discrete ice bodies. The ice body forming means conventionally includes an evaporator structure for forming ice from water suitably delivered thereto.

In one form of such ice making apparatus, the ice is formed as a slab on an evaporator plate and then delivered to an ice slab dividing means which may comprise a wire grid with means for heating the wires of the grid so as to cause the ice slab resting thereon to be divided into discrete ice body portions.

It is further conventional in the refrigeration art to form the cabinet defining the refrigerated chamber in which the ice body forming means is disposed as an insulated cabinet having an outer shell, an inner liner, and a suitable insulation disposed between the shell and liner. It is further conventional in refrigeration apparatus to utilize a liner formed of synthetic resin. The outer shell is conventionally formed of a rigid strong material, such as metal.

A problem has arisen in the prior art ice maker structures which have been mounted to the liner so as to be disposed within the refrigerated chamber. The relatively more frangible liner material at times cracks and, in general, did not provide an optimum strong support for the ice making apparatus. The problem becomes more vexatious where the ice making apparatus comprises a commercial ice making apparatus which is relatively large and heavy so as to place greater strain on the synthetic resin liner material.

A number of different cabinet constructions have been developed in the art of appliance cabinets. Illustratively, in U.S. Pat. No. 3,294,461 of Walter C. Barnard et al, which patent is owned by the assignee hereof, a door construction is shown having means for removably securing a front panel to the door.

In U.S. Pat. No. 3,421,803 of Leonard C. Lustig, which patent is owned by the assignee hereof, a cabinet structure is shown wherein the basket supports are mounted to the liner of the freezer chest.

William J. Gartner discloses in U.S. Pat. No. 3,501,215, a support device for insulated storage containers wherein the shelf supports extend outwardly through the inner insulation liner to the outer shell portion of the cabinet.

In U.S. Pat. No. 3,669,520 of Robert A. Jansen, a refrigerator is shown wherein the shelf supports are received in grommets mounted in the liner and extending into the insulation body.

Charles E. Sulcek discloses, in U.S. Pat. No. 3,773,399, which patent is owned by the assignee hereof, a refuse compactor having interchangeable front panels and means for removably securing the panels in the compactor drawer front.

In U.S. Pat. No. 3,858,409, which patent is owned by the assignee hereof, Wayne L. Besing shows a refrigerator construction wherein a groove device containing the refrigerant lines is located on the sidewall of the cabinet. A cover strip is provided for closing the groove device.

Another patent owned by the assignee hereof is that of Robert E. Lindenschmidt, U.S. Pat. No. 3,910,658. As shown therein, the shelf support is mounted to the liner of the refrigerator cabinet.

A similar construction is shown in U.S. Pat. No. 3,913,996 of Arthur E. Benford, which patent is also owned by the assignee hereof. Still another similar patent is that of Charles W. Haag, U.S. Pat. No. 3,933,398, which patent is also owned by the assignee hereof.

Arthur E. Benford shows, in U.S. Pat. No. 3,989,329, which patent is owned by the assignee hereof, a further similar construction.

In U.S. Pat. No. 3,999,820, which patent is owned by the assignee hereof, Charles W. Haag shows a refrigeration apparatus wherein a connector extends fully through the liner and insulation of the refrigerator cabinet.

In U.S. Pat. No. 4,006,947, which patent is owned by the assignee hereof, Charles W. Haag et al show a liner construction having novel securing means.

Walter C. Barnard et al, in U.S. Pat. No. 4,087,143, which patent is owned by the assignee hereof, show an ice maker cabinet door construction wherein the door panel is reinforced by a framework. A portion of the door is clamped between a portion of the framework and a support rail.

DISCLOSURE OF INVENTION

The present invention comprehends an improved ice maker construction wherein the ice making apparatus is carried on a support means fixedly secured to the shell outer wall of the cabinet. The support means is arranged to extend inwardly into the refrigerated chamber of the ice maker for supporting the ice making apparatus within the chamber.

The support is carried by the metal shell of the cabinet so as to eliminate the need for mounting any portion thereof on the inner liner of the cabinet.

The shell may include a turned portion extending inwardly toward the liner. The support may be removably secured to the turned portion as by further securing means.

In the illustrated embodiment, the support comprises a rod structure having means at the ends thereof for removable attachment to the cabinet shell.

In the illustrated embodiment, the support comprises a pair of rails. The ice making apparatus includes a plurality of components such as an ice slab forming evaporator portion and a wire grid slab dividing portion. The rails are arranged to mount each of the components in operative association with each other, providing further improved mounting of the ice making apparatus in the ice maker cabinet.

The apparatus of the present invention is extremely simple and economical of construction while yet providing the highly improved ice making apparatus mounting structure as discussed above.

BRIEF DESCRIPTION OF THE DRAWING

Other features and advantages of the invention will be apparent from the following description taken in connection with the accompanying drawing wherein.

BEST MODE FOR CARRYING OUT THE INVENTION

Figure 1:
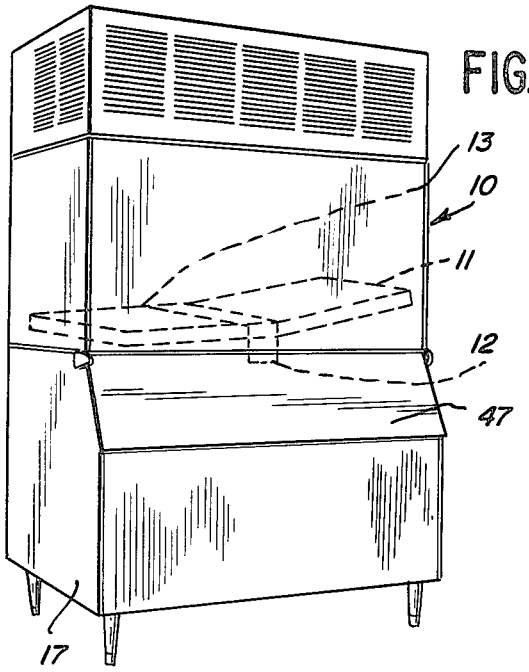
FIG. 1 is a perspective view of an ice maker having an improved means for mounting the ice making apparatus therein embodying the invention.

In the exemplary embodiment of the invention as disclosed in the drawing, an ice maker generally designated 10, which illustratively may comprise a commercial ice maker, of the type having an evaporator 11 adapted to form a slab of ice as a result of the re-circulation of water over the evaporator. The circulated water is collected in a trough 12 and suitably pumped in a re-circulating manner until the desired thickness of the slab is reached. The ice maker then automatically effects a release of the slab from the evaporator 11, discontinues further circulation of the water, and causes a dividing of the slab into discrete ice bodies by a suitable divider means, such as heated wire grid means 13. One example of such a commercial ice maker is illustrated in greater detail in U.S. Pat. No. 4,009,594 of Donald F. Swanson, which patent is owned by the assignee hereof, and which patent is incorporated by reference herein for a disclosure of the details of the ice making apparatus.

Figure 2:
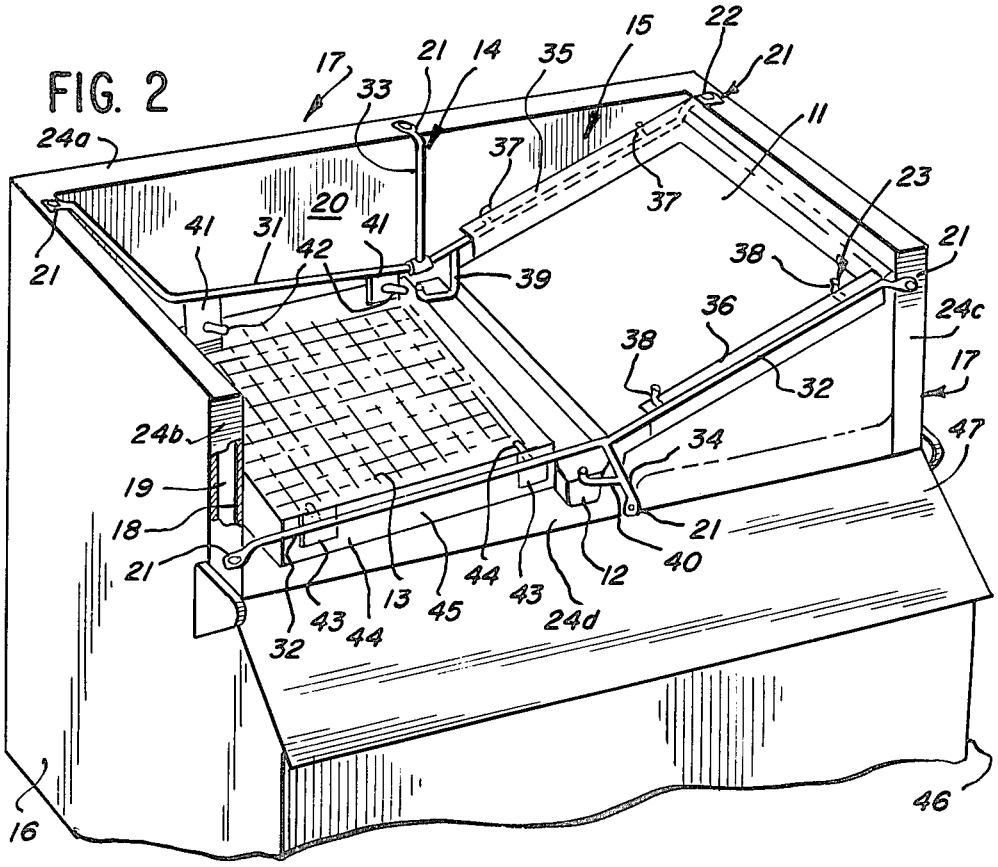
FIG. 2 is a fragmentary perspective view of the ice maker with portions removed to facilitate illustration of the ice making apparatus mounting means.

The present invention comprehends an improved support means generally designated 14 for supporting the ice making apparatus generally designated 15, including the evaporator 11, trough 12, and divider 13, as shown in FIG. 2. More specifically, the invention comprehends an improved support means 14 which is arranged to support the ice making apparatus 15 on the outer shell 16 of the cabinet 17 of ice maker 10. As shown in FIG. 2, the cabinet includes an inner liner 18 which is spaced from the outer shell 16 by a body of insulation 19, such as foamed-in-place urethane insulation. Liner 18 may be formed in a conventional manner of a suitable synthetic resin. Thus, the present invention eliminates the problem found in prior art devices wherein internal apparatuses have been mounted to the more frangible liner wall by providing the improved support means 14 adapted to support the apparatus 15 on the outer shell. More specifically, the support means 14 is adapted to be secured to the outer shell without going through the insulation means 19, thereby to maintain the insulating integrity of the cabinet while, at the same time, providing a positive rigid support of the apparatus 15 within the refrigerated chamber generally designated 20 defined by the inner liner 18.

Support means 14 further mounts each of the elements of the ice making apparatus 15 in operative association with the others so as to provide a further improved mounting of the apparatus.

As seen in FIG. 2, the support means 14 comprises a wire rod support having a plurality of supporting portions 21 removably secured to the cabinet shell 16 as by threaded fasteners or securing means 22. The support means 14 further defines mounting means generally designated 23 for supporting the ice making apparatus 15.

Figure 5:
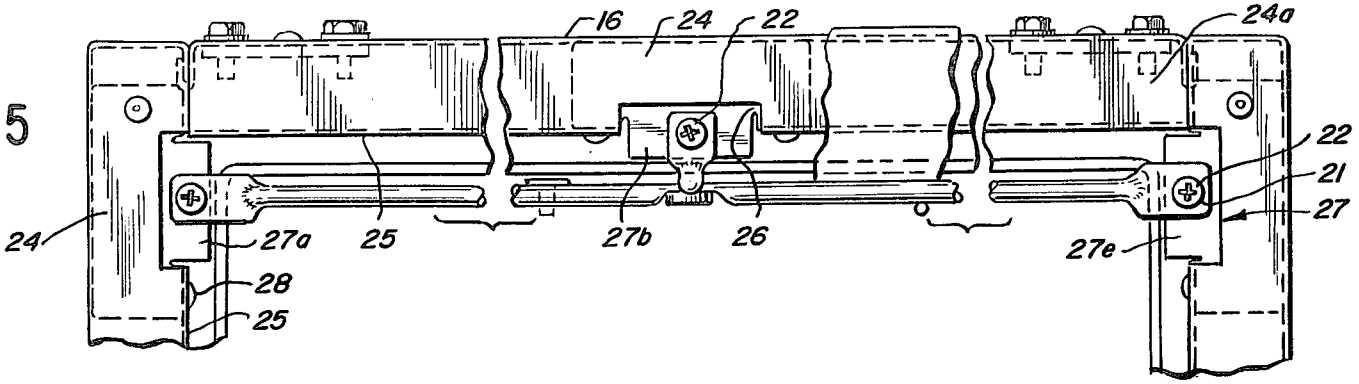
FIG. 5 is a fragmentary plan view of the cabinet construction illustrating the means for connection of the support means to the cabinet.
Figure 6:
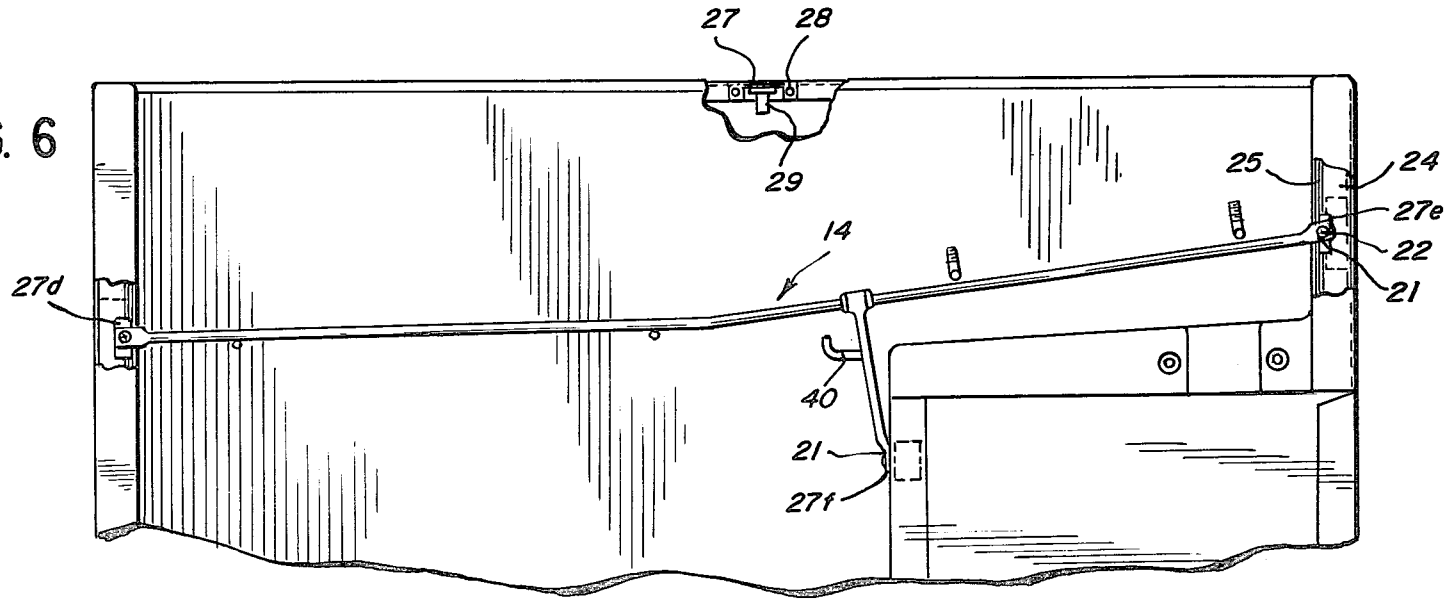
FIG. 6 is a fragmentary front elevation thereof.

As best seen in FIGS. 5 and 6, shell 16 includes a turned flange portion 24 having a further re-turned distal portion 25. Flange portion 24 is provided with a plurality of recesses 26 for accepting a corresponding plurality of mounting plates 27 which may be secured to the shell structure by suitable securing means, such as screws 28 extending through the distal portions 25, as best seen in FIGS. 5 and 6.

As further shown in FIGS. 5 and 6, the mounting plates are provided with a female threaded portion 29 adapted to receive the threaded securing means 22. In the illustrated embodiment, the female threaded portion may comprise a nut welded to the plate 27.

Figure 3:
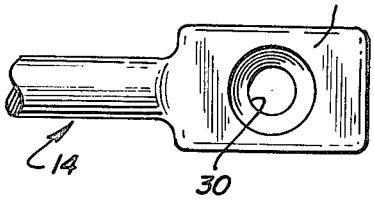
FIG. 3 is a fragmentary enlarged view of a securing portion of the support means.
Figure 4:
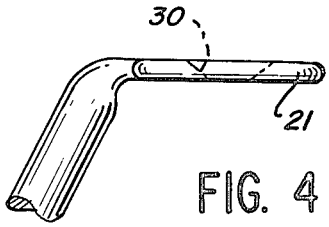
FIG. 4 is a fragmentary side elevation thereof.

As best seen in FIGS. 2 and 6, shell 16 defines a horizontal, upper flange portion **24*a*, first and second front vertical portions 24*b* and 24*c*, and a third front portion 24*d*. The support means supporting portions 21, as illustrated in FIGS. 3 and 4, comprise flattened end portions having suitable apertures 30 therein for passing the threaded securing screws 22. As shown, the mounting plates 27 are located in the respective flange portions 24*a*, 24*b*, 24*c*, and 24*d* for alignment with the respective connecting portions 21 of the support means. More specifically, the support means includes three connecting portions arranged to be secured to the horizontal mounting plates 27*a*, 27*b*, and 27*c* in the top flange 24*a*, as best seen in FIG. 5. A pair of supporting portions 21 are adapted to be secured to the mounting plates 27*d* and 27*e* illustrated in FIG. 6. Another supporting portion 21 is adapted to be connected to the front mounting plate 27*f*, also illustrated in FIG. 6**.

As further shown in FIG. 2, support means 14 includes a rear rod support 31 and a front rod support 32. A connecting rod portion 33 extends from rear rod support 31 to adjacent the mounting plate **27*b* and a connecting rod portion 34 extends from the front rod support 32 to adjacent the front mounting plate 27*f*, thereby permitting the support means 14 to be rigidly secured to the shell 16 by the threaded securing of the supporting portion 21 thereof to the respective mounting plates 27*a–f***, in turn fixedly secured to the shell flange portions.

As further shown in FIG. 2, evaporator 11 may be provided with turned side flanges 35 and 36. Rear rod support 31 is provided with a pair of stub hook portions 37 for engaging side flange 35 and front rod support 32 is provided with a pair of turned hook portions 38 for engaging side flange 36 for supporting the evaporator 11 in operative position within the chamber 20, the various hook portions cooperatively defining said mounting means 23.

As further shown in FIG. 2, rear rod support 31 is provided with a hook 39 and front rod support is provided with a hook 40 extending from the connecting rod portion 34, as shown in FIG. 2. Hooks 39 and 40, in turn, support the water trough 12 in operative association with the evaporator plate 11, as shown in FIG. 2.

As further shown in FIG. 2, rear rod 31 is provided with a pair of depending brackets 41, each carrying an inwardly projecting stub rod 42 and front rod 32 is provided with a corresponding pair of brackets 43, each provided with an inwardly extending stub rod 44 engaging the frame 45 of slab divider 13 for supporting the slab divider in operative association with the evaporator 11 so as to suitably receive the formed ice slab therefrom and effect the desired division thereof into the discrete ice bodies as discussed above.

As illustrated in FIG. 2, cabinet 17 further defines a lower portion 46 for receiving the divided ice bodies from the dividing means 13. Support means 14 mounts the ice making apparatus 15 suitably to effect the delivery of the ice bodies for storage in the lower portion 46 which may be provided with an access door 47 providing access to the lower portion 46 of the cabinet.

By securing the support means 14 to the strong and rigid outer shell 16 of the cabinet, the present invention permits free unrestricted thermal expansion of the plastic liner 18 and the insulation 19, thereby avoiding stresses tending to crack the liner and insulation as in prior art structures wherein supports have been mounted directly to the liner. Illustratively, in the conventional ice maker, the liner is formed of molded polyethylene and the shell is formed of metal. Thus, mounting of the support means 14 to the metal shell provides a substantial improvement in the strong, crackfree mounting of the relatively heavy ice making apparatus in the ice maker 10.

Further, the improved support means 14 provides a positive aligned mounting of the components of the ice making apparatus 15 for further improved functioning of the ice maker. In the illustrated embodiment, the rods forming the support means 14 may comprise 5/16" diameter stainless steel rods with the connecting rods and supports being welded thereto to provide a strong unitary support structure.

The foregoing disclosure of specific embodiments is illustrative of the broad inventive concepts comprehended by the invention.

We claim:

1. In an ice maker having a cabinet defined by an outer rigid shell, an inner liner, and insulation between said shell and liner, said cabinet liner defining a chamber, and ice making apparatus including a plurality of components, the improvement comprising:

support means having supporting portions fixedly secured to said shell and extending exteriorly of said insulation free of connection to the liner, said support means defining mounting means disposed within said chamber, said ice making apparatus components being mounted to said mounting means to be disposed within said chamber in operative association with each other while being supported as a whole on the outer shell.

2. The ice maker structure of claim 1 wherein said shell is formed of metal.

3. The ice maker structure of claim 1 wherein said liner is formed of a synthetic resin.

4. The ice maker structure of claim 1 wherein said shell includes turned portions extending inwardly toward said liner, and said support means is fixedly secured to said turned portions of the shell.

5. The ice maker structure of claim 1 wherein said support means comprises a rod structure and said mounting means comprises means on the rod structure for engaging said ice making apparatus to support the ice making apparatus on the rod structure.

6. The ice maker structure of claim 1 wherein said mounting means includes spaced portions for individually mounting each of the components.

7. In an ice maker having a cabinet defined by an outer metal shell, an inner liner, and insulation between said shell and liner, said cabinet liner defining a chamber, and ice making apparatus, the improvement comprising:

a pair of rails having supporting portions fixedly secured to said shell free of connection to the liner and mounting means disposed within said chamber, said ice making apparatus having spaced portions mounted to said mounting means to be disposed within said chamber while being supported as a whole on the outer shell.

8. The ice maker structure of claim 7 wherein said ice making apparatus includes a plurality of components and said mounting means defines spaced supports for supporting each of the components individually.

9. The ice maker structure of claim 7 wherein said supporting portions of the rails comprise flat end portions thereof.

10. The ice maker structure of claim 7 wherein said supporting portions of the rails comprise flat end portions thereof and means are provided for removably securing said end portions to said shell.

11. The ice maker structure of claim 7 wherein said supporting portions of the rails comprise flat end portions thereof removably secured to said shell by threaded securing elements extending through said securing portions and threaded to said shell.

12. The ice maker structure of claim 7 wherein said mounting means of the rails comprises a plurality of stub members supportingly engaging said spaced portions of the ice making apparatus.

13. In an ice maker having a cabinet defined by an outer rigid shell, an inner liner, and insulation between said shell and liner, said cabinet liner defining a chamber, and ice making apparatus, the improvement comprising:

flange means on said shell extending inwardly toward said chamber; and support means having supporting portions secured to said shell flange means and defining mounting means disposed within said chamber, said ice making apparatus including a plurality of components each of which is mounted to said mounting means.

14. The ice maker structure of claim 13 wherein some of said flanges extend horizontally and some of said supporting portions overlie the flanges.

15. The ice maker structure of claim 13 wherein some of said flanges extend vertically and define an access opening to said chamber, and some of said supporting portions are disposed outwardly of the flanges.

16. The ice maker structure of claim 13 wherein said supporting portions engage outer surfaces of said flanges and said support means includes connector portions extending inwardly from said supporting portions to dispose said mounting means within said chamber.

17. The ice maker structure of claim 13 wherein said ice making apparatus includes means for forming a slab of ice and means dividing the slab into discrete ice bodies, said mounting means individually supporting each of said slab forming means and dividing means in operative association.

* * * * *